US005933986A

United States Patent [19]

Donnadieu

[11] Patent Number: 5,933,986

[45] Date of Patent: Aug. 10, 1999

[54] LATERAL STABILITY DEVICE FOR SPORT BOOT

[75] Inventor: Thierry Donnadieu, Poisy, France

[73] Assignee: Salomon S.A., Cedex, France

[21] Appl. No.: 08/811,293

[22] Filed: Mar. 4, 1997

[30] Foreign Application Priority Data

Mar. 4, 1996 [FR] France ..... 96 02864

[51] Int. Cl.[6] ..... A43B 7/20; A43B 5/04

[52] U.S. Cl. ..... 36/89; 36/118.2

[58] Field of Search ..... 36/89, 117.1, 117.2, 36/118.2, 118.3, 119.1

[56] References Cited

U.S. PATENT DOCUMENTS

| | | | |
|---|---|---|---|
| 4,317,296 | 3/1982 | Hanson | 36/118.2 |
| 5,526,556 | 6/1996 | Foscaro | 36/118.2 |
| 5,575,091 | 11/1996 | Mattiuzzo | 36/118.2 |
| 5,675,917 | 10/1997 | Falguere et al. | 36/117.2 |

FOREIGN PATENT DOCUMENTS

| | | |
|---|---|---|
| 0 416 437 A1 | 3/1991 | European Pat. Off. . |
| WO 91/07889 | 6/1991 | WIPO . |
| WO 95/21549 | 8/1995 | WIPO . |

*Primary Examiner*—B. Dayoan
*Attorney, Agent, or Firm*—Pollock, Vande Sande & Amernick

[57] ABSTRACT

The sport boot comprises an upper and at least two reinforcing elements (21, 22) arranged medially and laterally in the area of the user's ankle. The lateral reinforcing element (22) extends higher along the ankle than does the medial reinforcing element (21). Advantageously, the lateral reinforcing element (22) is equipped with a flexibility-enhancing feature (27, 28) at its upper end.

8 Claims, 2 Drawing Sheets

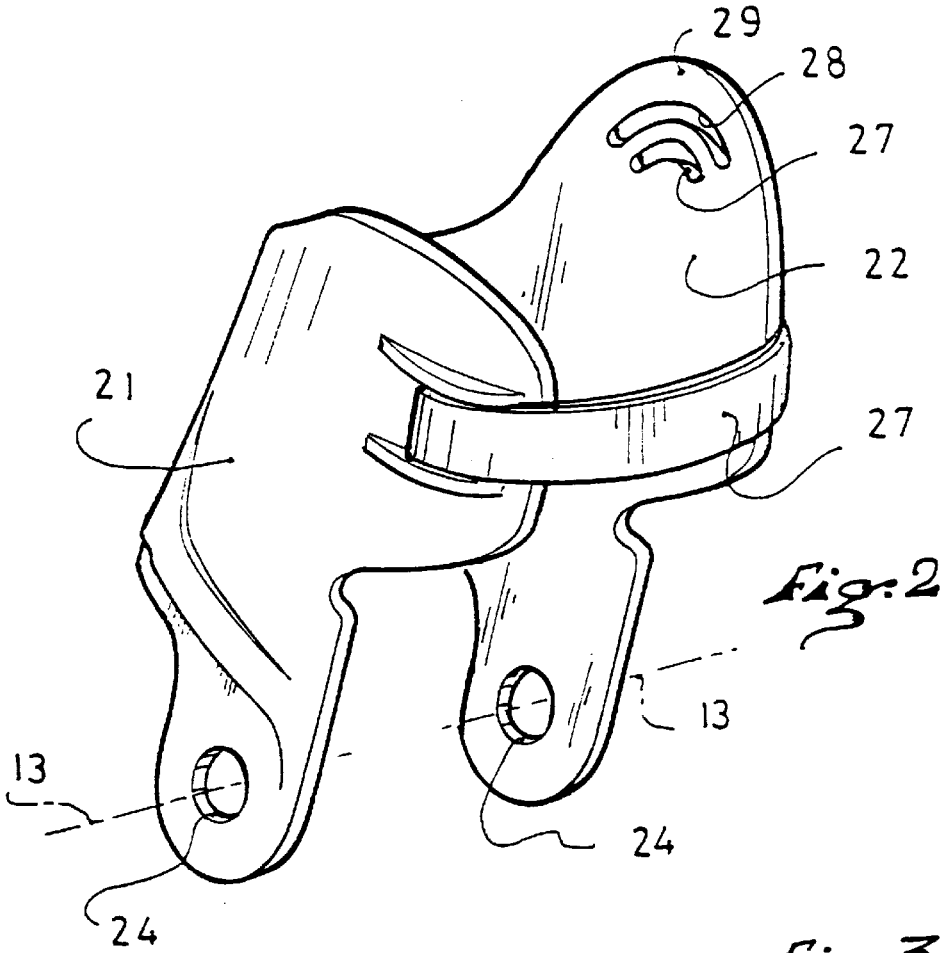
Fig. 2
Fig. 3
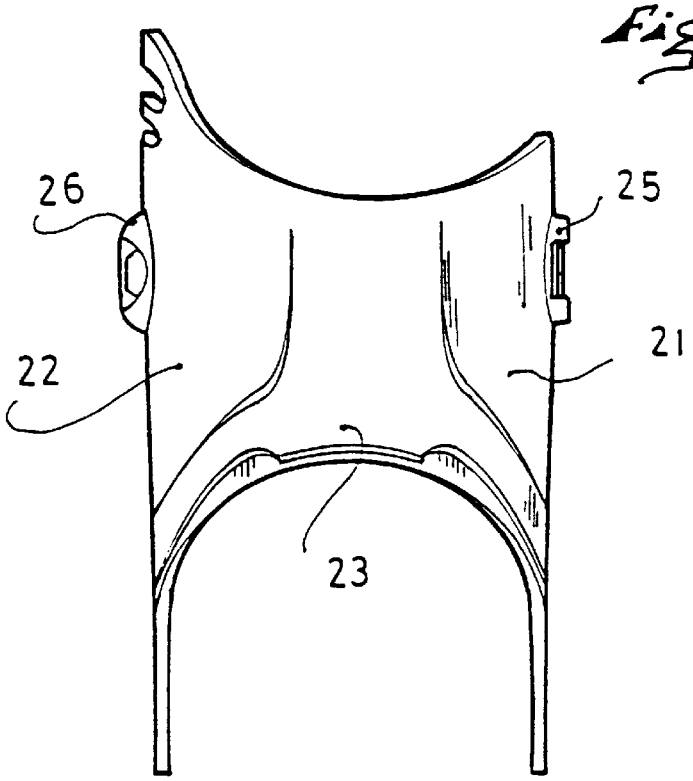

LATERAL STABILITY DEVICE FOR SPORT BOOT

FIELD OF THE INVENTION

The invention concerns a sport boot of the type comprising a relatively rigid collar or upper portion enclosing the user's ankle at least partially, in order to increase the lateral stability of the ankle.

BACKGROUND OF THE INVENTION

Boots of this kind are designed for sports requiring effective transmission to the foot of the forces generated by the user's leg, in order to obtain better traction, gripping of the ski edge, or enhanced momentum.

These sports include sliding sports such as skiing, cross-country skiing, snowboarding, skateboarding, in-line skating, etc., but also walking sports requiring that the foot be extended or the ankle bent in relation to the foot, for example, snowshoeing, cross-country skiing, walking, hiking, etc.

In all of these cases, the forces generated by the user's leg are transmitted through the ankle to the foot. Accordingly, the ankle must be held laterally in position sufficiently to ensure the continuous transmission of information and stresses from the leg to the foot.

To meet this requirement, the boots designed for the practice of these sports are normally fitted with lateral reinforcing pieces in the upper portion surrounding the ankle.

Depending on the sport, moreover, these lateral reinforcing pieces are designed to permit or prevent movements of ankle flexion in relation to the foot, these movements occurring basically in the longitudinal direction of the foot.

Thus, FR 2 651 416 suggests fitting the upper of a sport boot with a rigid collar hinged on this upper. This collar provides excellent lateral position maintenance of the ankle, while ensuring excellent front-to-back mobility of the ankle in relation to the foot. A structure of this kind is, accordingly, particularly well suited to the practice of sports requiring front-to-back mobility of the ankle in relation to the foot, that is, walking, cross-country skiing, skating, etc.

In sports where this front-to-back mobility of the ankle in relation to the foot is not desired, the boot is generally manufactured as a shell made of a rigid material, normally a plastic, surmounted by a collar, a cuff, etc. made of one or several components and rigidly enclosing the ankle and/or lower leg of the user and being allowed only very restricted motion, or even no motion at all, in relation to the shell. These boots typically include alpine ski boots and some skating boots. Conventional practice also include reinforcing the portion enclosing the ankle of a boot only with reinforcing pieces arranged laterally and medially, that is, extending toward the outside and inside of the foot.

SUMMARY OF THE INVENTION

The invention is intended a provide a structure of a boot of the type comprising a relatively rigid collar or upper portion surrounding at least partially the user's ankle and making it possible to further increase the lateral stability of the user's ankle and the transmission of stresses and sensations from the leg to the foot, and vice-versa.

This goal is achieved in the sport boot according to the invention, which is of the type comprising an upper and at least two reinforcing elements arranged medially and laterally in the part corresponding to the wearer's ankle, by virtue of the fact that the lateral reinforcing element extends higher along the ankle does than the medial reinforcing part.

Paradoxically, although the need for ankle support is, in fact, sought on the medial side of the ankle, it has been found that such an arrangement improves substantially the transverse position-maintenance of the ankle.

This paradox can be explained by the fact that the reinforcing piece/leg contact surface is increased, in particular when edge-gripping or momentum-producing movements are effected, and that the proprioceptive movements generated during such movements are thus intensified.

As a result, information is transmitted upward more effectively, in particular spatial information regarding the relative position of the foot in relation to the leg, and, in consequence, the user can instinctively straighten out his foot again in relation to his ankle, thus gaining increased lateral stability of the ankle.

Advantageously, the lateral reinforcing portion is rendered more supple at its upper end so as not to cause discomfort to the user and in order to form only one additional mechanism for information transmission.

BRIEF DESCRIPTION OF THE DRAWINGS

The invention will be better understood and other features will emerge by virtue of the following description provided with reference to the schematic drawings illustrating several embodiments by way of non-limiting examples, and in which:

FIG. 2 is a perspective view of the collar of the boot in FIG. 1,

FIG. 3 is a rear view of the collar in FIG. 2.

DESCRIPTION OF THE PREFERRED EMBODIMENT

Figure 1:
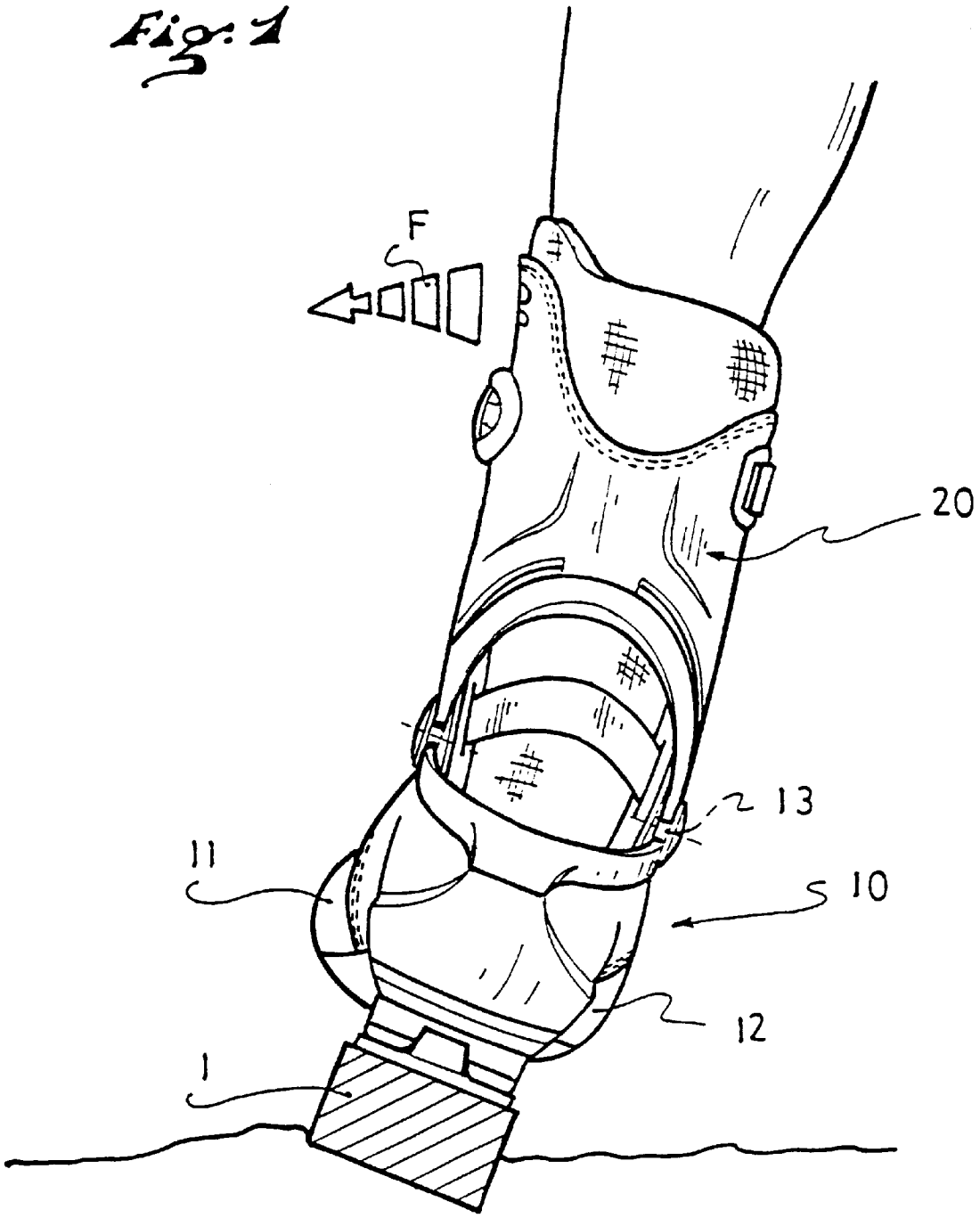
FIG. 1 is a rear view of a boot according to the invention.

FIG. 1 illustrates a boot 10 for cross-country skiing 1 or skating fitted with a reinforcing structure according to the invention.

This boot 10 is constituted, in conventional fashion, by an upper 11 and a heel stiffener 12 and by a collar 20 hinged on the heel stiffener of the upper using two hinge pins 13.

The upper 11 may be a low-cut upper, that is, an upper whose rigid parts do not extend upward beyond the malleoli so as not to impede the movements of forward or rearward pivoting of the hinged collar 20. This structure is disclosed, for example, in FR 2 651 416.

The upper may also be a high-cut upper which, in consequence, restricts the pivoting motion of said collar 20.

Accordingly, as shown more especially in FIG. 2, the collar 20 is made of a relatively rigid plastic material, such as Pebax 4033 to 7033, and is constructed of two substantially vertically reinforcing elements 21, 22 arranged medially and laterally and of a substantially horizontal part 23 connecting the two elements 21, 22.

Each reinforcing element 21, 22 extends upward from a zone in which the hinge pins 13 are housed and which incorporates suitable holes 24, this zone being located substantially in the area where the foot is joined to the leg or below that area, to a zone corresponding substantially to the lower calf, so as to cover the entire ankle-articulation area.

Each reinforcing element 21, 22 is, moreover, fitted conventionally with anchoring/locking means 25, 26 used for a velcro/hook-type collar-tightening system 27.

As shown in the various figures, and, in particular, in FIG. 1, the reinforcing element 22, which is arranged laterally, that is, on the outside of the leg, extends higher along the user's ankle than does the reinforcing element 21 arranged medially, that is, on the inside of the leg.

The result is a larger surface area of contact between the collar and the leg on the outside of the leg, and, therefore, improved lateral position-maintenance of the ankle, in particular when the user executes gripping motions or digs in with the ski edge, as shown in FIG. 1.

Furthermore, the lateral reinforcing element 22 is equipped, in proximity to the upper edge thereof 29, with two superposed semi-circular slots 27, 28 which substantially match the contour of said upper edge 29. These two slots 27, 28 constitute means for enhancing the transverse flexibility of said lateral reinforcing element, thus enabling this element to "follow" the movement of the ankle when an outward force "F" is generated (see FIG. 1).

This structure makes possible the maintenance of close contact between the collar and the leg, without creating any hard spot or point of discomfort for the leg because of the height of the collar in this zone.

Of course, other means for enhancing the transverse flexibility of the upper edge 29 of the reinforcing element 22 could be provided, for example substantially vertical slots arranged in a fan shape in order to allow a fan-shaped opening effect of the collar, or a part made of an elastic material and arranged on this upper edge.

In addition, other embodiments of the reinforcing elements can be imagined, and these reinforcing elements could, for example, be constituted by simple vertical plates not connected by a horizontal element 23 and suitably fastened to the boot upper.

Similarly, the freedom of forward/rearward movement of the collar, for example for use in an alpine ski boot, could be eliminated while still remaining within the scope of the present invention.

What is claimed is:

1. A sport boot of the type comprising an upper and at least one lateral and one medial reinforcing element arranged in an area of an ankle of a user wherein said lateral reinforcing element extends higher along said ankle than does said medial reinforcing element and is fitted with flexibility-enhancing means at its upper end.

2. The sport boot according to claim 1, wherein the flexibility-enhancing means are constituted by at least one slot (27, 28) arranged in proximity to the upper end of the lateral reinforcing element.

3. The sport boot according to claim 2, wherein said at least one slot (27, 28) is substantially arc-shaped.

4. The sport boot according to claim 2, wherein said at least one slot (27, 28) substantially matches the contour of the upper edge.

5. The sport boot according to claim 1, wherein each reinforcing element is constituted by a substantially vertical plate made of a plastic material arranged medially and laterally on the upper.

6. The sport boot according to claim 1, wherein the at least two reinforcing elements form part of a single collar (20) enclosing the user's ankle.

7. The sport boot according to claim 1, wherein the collar (20) is mounted so as to be freely articulated on rigid parts of the upper.

8. A sport boot having an asymmetrical structure comprising an upper and at least one lateral and one medial reinforcing element arranged in an area of an ankle of a user, said lateral reinforcing element extending higher along said ankle than does said medial reinforcing element.

* * * * *